United States Patent [19]

Beach

[11] Patent Number: 4,463,911

[45] Date of Patent: Aug. 7, 1984

[54] STRAP DISPENSER

[75] Inventor: John R. Beach, Elmhurst, Ill.

[73] Assignee: Signode Corporation, Glenview, Ill.

[21] Appl. No.: 384,219

[22] Filed: Jun. 2, 1982

[51] Int. Cl.[3] ..... B65H 19/10

[52] U.S. Cl. ..... 242/55.2

[58] Field of Search ..... 242/55.2, 105, 54 R, 242/DIG. 2, 55, 128

[56] References Cited

U.S. PATENT DOCUMENTS

| | | | |
|---|---|---|---|
| 2,893,657 | 7/1959 | van de Bilt | 242/128 |
| 3,224,705 | 12/1965 | Nash | 242/105 |
| 3,815,844 | 6/1974 | Wright et al. | 242/54 R X |
| 3,868,069 | 2/1975 | Schulz | 242/128 |
| 4,153,499 | 5/1979 | Annis | 100/27 X |
| 4,290,561 | 9/1981 | Satzinger | 242/55 |

*Primary Examiner*—Stuart S. Levy
*Assistant Examiner*—Scott J. Haugland
*Attorney, Agent, or Firm*—Dressler, Goldsmith, Shore, Sutker & Milnamow, Ltd.

[57] ABSTRACT

The invention relates to a dispenser wherein strap is withdrawn over the side of the reel in a non-tangential direction and pulled outwardly along the axis of the reel. This causes a twist in the strap but this is removed by rotating the reel in a circumferential direction opposite to that which it has been withdrawn to remove the twist in the strap before it is used.

3 Claims, 6 Drawing Figures

FIG. 1
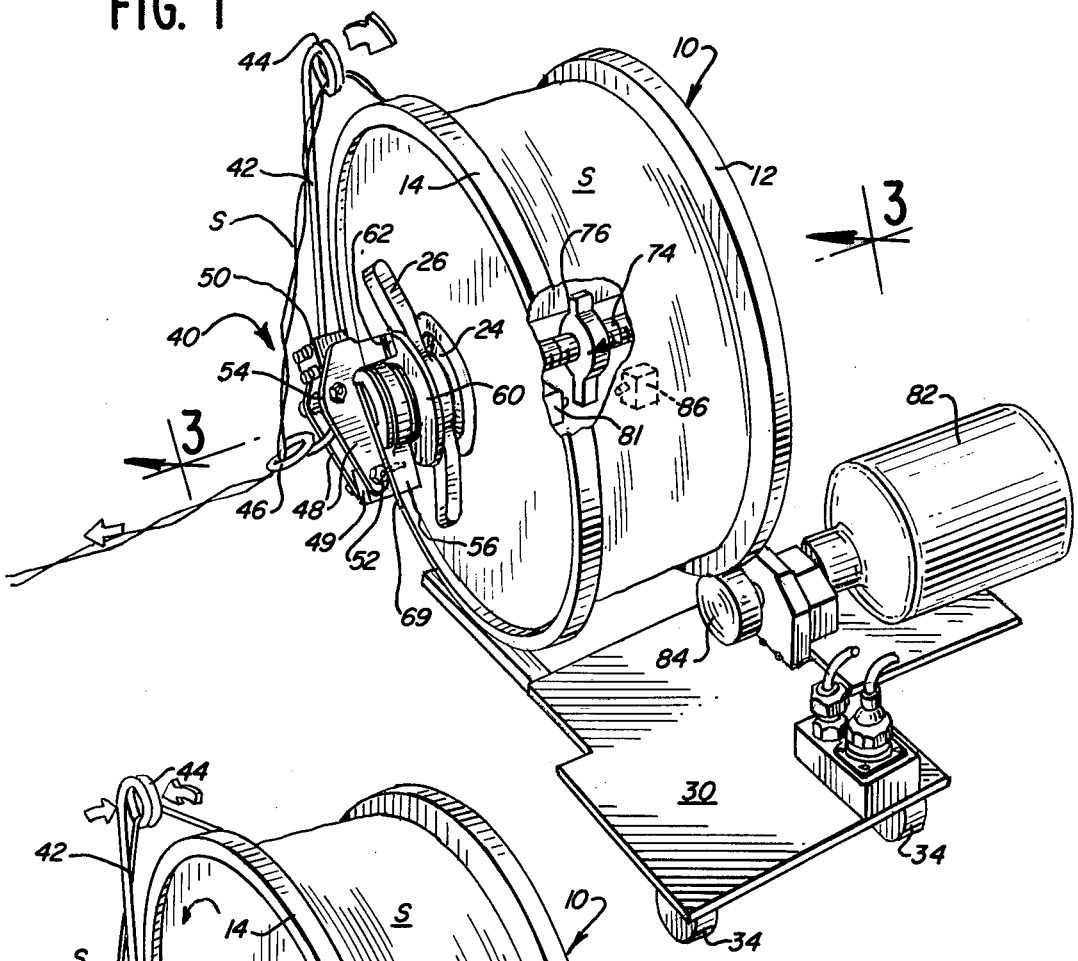
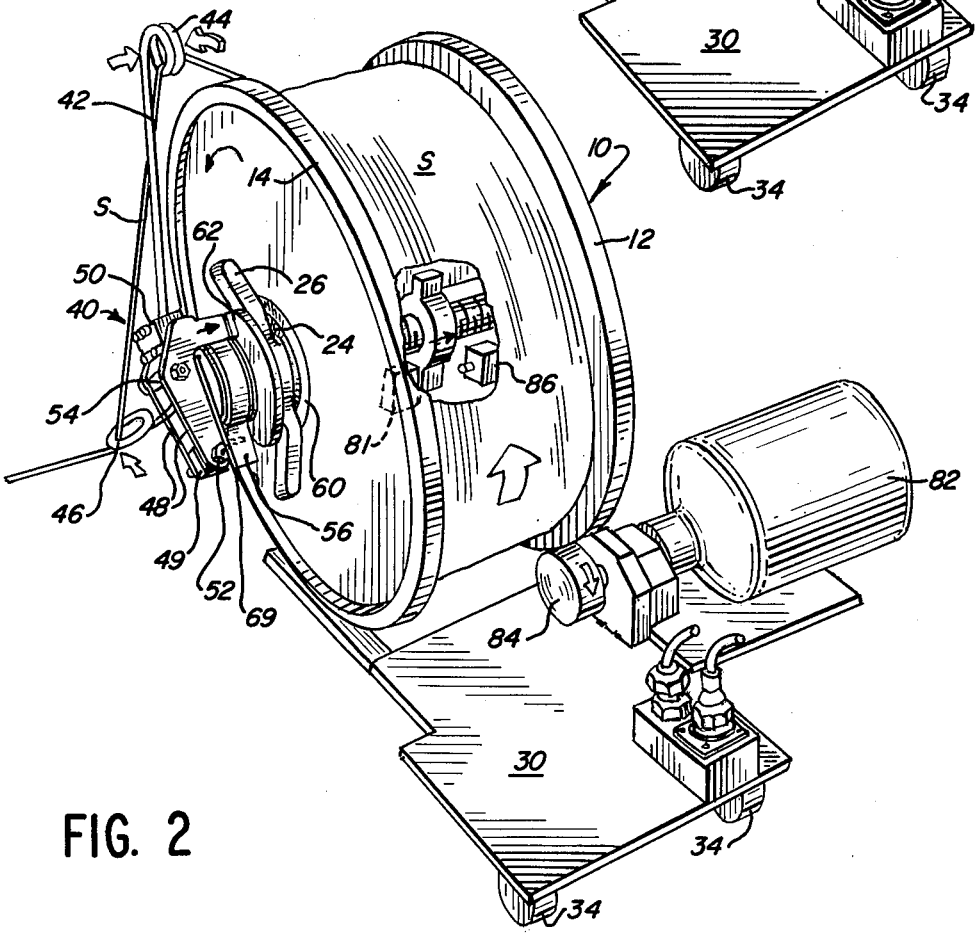
FIG. 2

FIG. 3
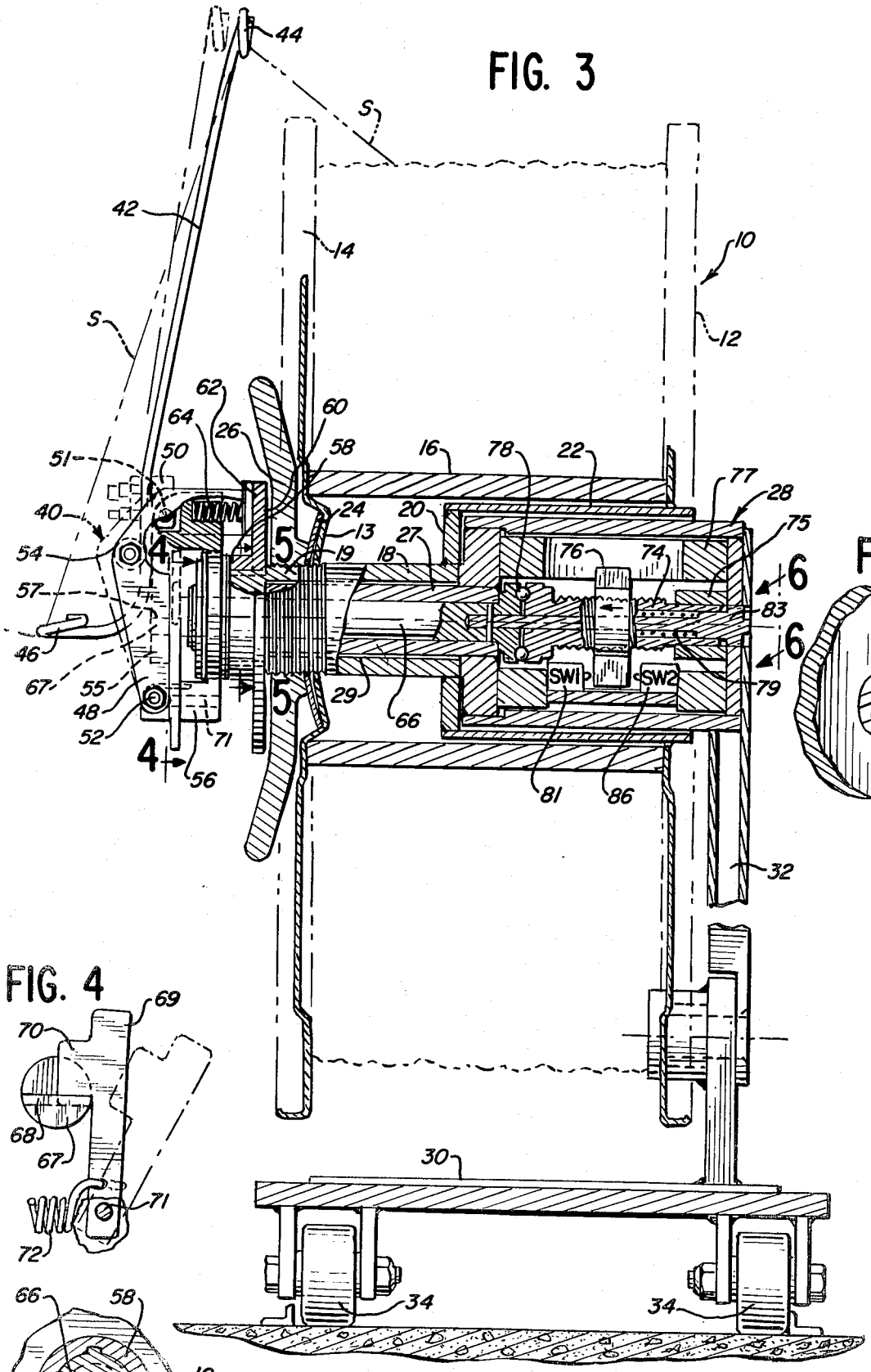
FIG. 6
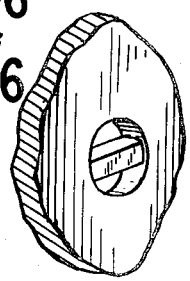
FIG. 4
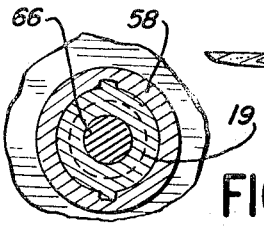
FIG. 5

STRAP DISPENSER

TECHNICAL FIELD

This invention relates to a movel method and apparatus for dispensing strap from a dispenser in a non-tangential direction during which strap is twisted, but is subsequently untwisted before utilization thereof.

BACKGROUND OF INVENTION

The present invention relates to a new and improved strap dispenser, in which the strap in coils may be removed at high speeds, either manually or automatically with minimal shock load to the dispenser and without strap overrun thereby eliminating the possibility of snarling of the unwound strap material.

It has been a common practice in the past to dispense the strapping tangentially from the strapping coil. For all such dispensers, the mass inertia of the strap coils must be overcome before the appropriate speed necessary for the dispensing process is reached. This mass and inertia was overcome primarily by the use of very large motors and some form of accumulator mechanism which allowed for the immediate supply of strapping to the strapping machine during the time that the motor acts on the reel to overcome the mass and inertia thereof. An example of an accumulator means appears in U.S. Pat. No. 4,153,499 granted to James R. Annis on May 8, 1979 and assigned to the assignee of the present invention.

Another problem associated with the prior art strap dispensers is that once this static inertia is overcome, there is a certain amount of rotational inertia which will continue to supply strapping even after the motor is deactivated. Various devices were used in the prior art strap dispensers to overcome the rotational inertia in order to prevent unneeded strapping from overrunning the machine resulting in strapping lying loose between the coil and the feed mechanism of the strapping machine which could result in tangling and snagging.

An additional problem has been created with the use of thinner non-metallic strapping since this thinner non-metallic strapping is difficult to thread in the accumulator mechanism.

There has been a need for a dispenser mechanism which will respond in accordance with the demand for strap material and which can stop and start easily in proportion to the demand for and the supply of the material with very simple operation. The present invention has solved the foregoing problems in a unique method. Strapping is removed non-tangentially from the reel of strapping. Such non-tangential removal of the strapping does not require the reel of strapping to be rotated in order to allow the strapping to reach the speed the demand requires. On the other hand, non-tangential removal of the strapping alone will create strapping that is twisted and will eventually snarl. To overcome this problem this new strap dispenser eliminates the twisting of the strapping by recording the circumferential movement of the strap about the circumference of the reel as the strapping is being removed and thereafter actuating a motor which will rotate the reel of strapping in the opposite direction an equivalent amount to eliminate the twist.

SUMMARY OF THE INVENTION

The improved strapping dispenser comprising the present invention has been designed primarily for use in connection with the dispensing of non-metallic strapping at a station where it is caused to encircle the object to produce a loop which is then tensioned about a package by a power operated strapping machine preparatory to adjoining the strap ends and severing the trailing end of the strap.

The strapping dispenser has a hub upon which a coil of strapping on a reel is allowed to freely rotate. The strapping is removed non-tangentially from the reel through a distal portion of a rotatably mounted arm fixed to a shaft axially and rotatably disposed within the reel of strapping. During withdrawal of the strap from the reel the arm is free to move relative to the strapping reel. The strapping is thereafter threaded through the pivotal end of the arm at a location substantially aligned along the axis of the shaft about which the reel is located and the strapping is thereafter connected to the strapping machine feed mechanism.

As strapping is pulled from the dispenser by the strapping machine (or manually if such is the case), the strapping first exerts a force on the pivotally mounted arm which thereby releases a brake which heretofore precluded movement of the arm relative to the reel allowing the arm to freely rotate relative to the reel to remove the strap from the reel in essentially a non-tangential direction. The end of the shaft opposite the end upon which the arm is fixed is threaded and on these threads is a nut which can move longitudinally on this shaft in response to the rotation of the shaft but is prevented from rotating on the shaft.

Removal of the strap in a non-tangential direction results in a certain amount of twist in the strap. The rotation of the shaft moves a nut longitudinally on the shaft and after a predetermined movement a switch is actuated to turn on a motor that rotates the reel and arm together in a direction opposite to that which the strap has been unwound to remove the twist from the strap previously unwound from the reel after which the motor will turn off. This action results in rotating the shaft to return the nut to its initial position.

Reference will now be made to the drawings illustrating an embodiment of the present invention wherein:

FIG. 1 is a perspective view of the strap dispenser assembly showing the strap in a twisted condition as it is being removed from the reel;

FIG. 2 is a perspective view of the strap dispenser assembly showing the strap being untwisted by the motor;

FIG. 3 is a view taken along line 3—3 of FIG. 1;

FIG. 4 is a view taken along line 4—4 of FIG. 3;

FIG. 5 is a view taken along line 5—5 of FIG. 3; and

FIG. 6 is a view taken along line 6—6 of FIG. 3.

Referring now particularly to FIG. 3 there is shown in cross-section the details of the novel reel dispenser assembly. The strap reel is indicated by the numeral 10 which is made up of two circular side plate members 12, 14 and a reel 16 on which strap S has been wound. The strap reel is supported by a hub assembly consisting of three members welded together. These three members comprise a tubular member 18, an annular plate 20 and a larger tubular member 22 which is shown connected to the circular side plate 12. The reel assembly consisting of members 12, 14, 16, 18, 20, 22 is retained in position by a hub nut 26 which is threaded onto the threaded portion 19 of hub member 18. Connected to the hub nut 26 is an end cap 24 that is thrust into contact with an adjacent annular flange 13 of the circular side plate 14. This reel assembly consisting of side plates 12 and 14, reel 16, hub members 18, 20 and 22 along with wing hub nut 26 comprise a unitary assembly that is supported on a stationary hub support assembly 28. The aforementioned reel assembly is rotatably supported on a stationary shaft sleeve 27 forming part of the stationary hub support assembly by bearings 29. It can thus be appreciated that the entire reel support assembly can be removed as an entity from the stationary hub support assembly when it is desired to replace an empty reel with a full reel of strap.

The stationary hub support assembly 28 the details of which will be described hereinafter is supported by a platform 30 through a support arm 32. The platform 30 can be moved to wherever desired on wheels 34.

As previously mentioned, the strap is removed in a nontangential direction from the strap reel 10. The strap S is withdrawn from the outer circumference of the reel 10 over the edge of side plate 14 and then radially inward to a location substantially at the axis of the shaft about which the reel assembly is free to rotate. The strap is then pulled in a generally axial direction to a strapping machine where it is wrapped and secured about a package. The mechanism for providing for strap withdrawal from the reel consists of a strap feeder assembly which is free to rotate relative to the reel. It is to be noted that during a method of operation where strap is not continuously being withdrawn from the reel the reel will remain stationery. However, if strap is being continuously withdrawn the reel will rotate in the opposite direction. In the illustrated embodiment, it is assumed that strap is not continuously withdrawn.

The strap feeder assembly 40 consists of a strap guide arm 42 which includes an upper guide arm loop 44 and lower guide arm loop 46 which is located approximately along the axis about which the strap reel rotates. The strap guide arm 42 is clamped in position relative to the strap feeder assembly 40 by an arm clamp 50 that is pivotably connected at 51 to housing 56. The lever arms 48 have disposed therebetween a section 49 of housing 56 (see FIG. 1) and the arms 48 and housing section 49 are connected by a pivot member 52 about which the lever arms 48 pivot. It is noted that the lever arms 48 are connected in an upper area thereof by means of a roller support assembly 54 which is suitably grooved to receive arm 42.

Also forming part of the strap feeder assembly is a block 55 located between arms 48 which defines a semi-cylindrical opening 57 for receiving the semi-cylindrical end 67 of a shaft 66 over which the strap feeder assembly is disposed and about which the reel assembly rotates. A housing 56 is also part of the strap feeder and housing 56 also defines an opening through which the cylindrical portion of shaft 66 extends. The strap feeder assembly 40 is connected to the shaft end 67 by means of a locking lever 69 which forms part of the strap feeder assembly. As shown in FIG. 4, the locking lever 69 is pivotally connected to the housing 56 by a pivot pin 71 and contains a lever latch 70 which is adapted to fit into a notch or shaft slot 68 formed in the semi-cylindrical end 67 of the shaft 66. The locking lever is biased into position in the shaft slot 68 by means of a spring 72 connected at one end to the housing 56 and at its other end to the lower end of the lever 69.

Insofar as the strap feeder assembly is concerned it remains to note that at the upper end of the lever arms 48 there is provided a brake pad 62 connected thereto which brake pad is biased outwardly by a spring 64 that is located between housing 56 and rod 62. The brake pad 62 is suitably connected to the arms 48 and retained in position with respect thereto.

The brake pad 62 is positioned to engage a brake disk 60 which is secured to a hub member 58 that is keyed to the end of hub member 18 (see FIG. 5). Thus, when the hub member 58 is rotated the brake disk 60 will rotate with it and if the brake 62 is in engagement therewith the strap feeder assembly will be rotated along with the brake disk 60. The description of this portion of the device will be dealt with in greater detail hereinafter.

Referring again to the strap feeder assembly it can be appreciated that the strap guide arm 42 is moved inwardly into the solid line position as shown in FIG. 3 when the strap is withdrawn from the reel over the side plate 14 and through the loops 44, 46. The strap leaving the loop 46 moves in an axial direction relative to the shaft 66 and the shaft feeder assembly 40 which has been pulled free of the brake disc 60 is free to rotate relative to the brake disk 60 and thus independent of the strap dispensing reel. As the strap is pulled in a non-tangential direction off of the strap reel, the strap feeder assembly which is thus free to rotate will move in a circumferential direction around the strap reel which remains stationary. As the strap is pulled out, the strap is twisted in the manner shown in FIG. 1. Specifically, as shown in FIG. 1, as the strap is pulled through the loop 46 through which the strap is fed after leaving the loop 44 the arm 42 rotates in a clockwise direction with respect to the stationary reel. During this action the strap is twisted (one 360° twist per revolution) and thus provision must be made to untwist the strap before it is wrapped around the package.

In order to accomplish this, there is provided a motor 82 and drive wheel 84 assembly to drive the strap reel in a counterclockwise direction as shown in FIG. 2 while at the same time maintaining the strap in a fixed position relative to the reel. Essentially, the strap is no longer being payed out from the reel and the movement of the reel functions to untwist the strap the same amount that it was originally twisted. To this end the strap feeder assembly is biased to move with the strap reel. To accomplish the foregoing, a switch and associated timing mechanism is employed so that after the strap has been removed from the reel and the switch is engaged a motor is actuated to reverse the rotation of the reel to untwist the stop. In the embodiment illustrated the paying out relative to the reel occurs in the clockwise direction and the reel is rotated in the counterclockwise direction an equivalent amount to take the twist out of the strap.

The mechanism for accomplishing the above consists of a threaded shaft 74 on which is located an axially movable nut 76. The threaded shaft 74 is connected to the shaft 66 secured to the strap feeder assembly through a spring loaded ball clutch 78 about which more will be stated later. The threaded nut 76 moves from right to left as the strap guide arm moves in a clockwise direction as shown in FIG. 1. The nut is prevented from rotating with the shaft 74 by a nut guide assembly 77.

Thus, as the strap feeder assembly is rotated in a clockwise direction free of the reel 10 the nut 76 is moved to the left into engagement with a switch 81. When the nut 76 engages switch 81 and the motor 82 is started and when the nut 76 is disengaged from switch 81 a timing mechanism is set into action and after a predetermined time interval related to the withdrawal of strap from the reel the motor 82 is turned off. Specifically, the drive wheel 84 which is in engagement with the flange of the circular side plate 12 of the strap dispenser 10 drives the reel assembly 10 in a counterclockwise direction relative to the stationary hub support assembly 28 until the motor stops. This rotation of the wheel results in the associated shafts 66 and 74 being rotated in a counterclockwise direction which moves the nut 76 axially to the right back into the neutral position shown in FIG. 1.

As previously stated the rotation of the strap dispenser in the counterclockwise direction generally corresponds to that which the strap feeder assembly and guide arm 42 moved in the clockwise direction which thus untwists the strap.

To accomplish the untwisting action the strap feeder assembly must remain in a fixed position relative to the strap reel 10 during counterclockwise movement of the reel. This occurs by virtue of the fact that when strap is no longer being dispensed from the reel spring 64 moves the brake pad 62 into engagement with the brake disc 60.

The switch 86 is not used during the illustrated method of operation. However, if the direction of rotation of the strap feeder and reel is reversed from that shown switch 86 would function in the manner discussed with respect to switch 81.

It remains to note that the slip clutch 78 that is located between the shafts 76 and 74 is provided in the event there is a tendency to turn the feeder assembly an additional amount after the nut 76 contacts the switch 80. When this occurs, the shaft 66 will slip relative to the shaft 74. The setting for the slip clutch is determined by the spring 79. The end of the shaft 74 is journaled in annular support 75. The adjustment of the position of the shaft 66 to receive the strap feeder assembly 40 is accomplished by a twist bar 83 that extends through the shaft 74 and is pinned to the shaft 66 (see FIG. 6).

It can be seen from the above that there is provided a novel strap dispenser in which the strap is moved non-tangentially from the reel, and the reel is maintained stationary during strap removal. While this causes twisting of the strap, the strap is untwisted by subsequent controlled movement of the reel in the opposite direction to that which the strap feeder assembly has been rotated while maintaining the strap feeder assembly fixed to the reel. Thus, there has been provided a novel dispenser which can stop and start easily in proportion to the supply of material with very simple operation.

It remains to note that the novel dispenser can be used when it is desired to continuously withdraw strap therefrom. In this situation, after strap is withdrawn non-tangentially in one direction and twisted the reel is driven in the opposite direction to untwist the strap. However, since the strap is continuously being pulled, the brake 62 is not engaged and the strap reel will move independently of the strap feeder assembly. The strap leaving the reel may or may not be twisted depending on the relative movement between the strap feeder assembly and the reel. If the take off speed is greater than the reel speed, some twist will occur but the motor will ultimately catch up to untwist the strap before it is used.

It is intended to cover by the following claims all improvements and modifications that fall within the true spirit and scope of the invention.

What is claimed is:

1. A strapping dispenser for dispensing strap axially from a reel of strap while correcting the twist caused by the axial removal of strapping from the reel, comprising: a frame, a reel assembly having a coil of strapping thereon, means for mounting the reel on said frame so that said reel may freely rotate about said mounting means, a freely rotatable shaft axially disposed within said mounting means, a strap feeder assembly secured to said shaft and constructed and arranged to rotate in one direction relative to said reel during strap removal in a non-tangential direction therefrom and outwardly generally along the axis of said shaft, means controlled by said shaft movement for connecting the strap feeder assembly to said reel and rotating the reel and strap feeder assembly in the opposite direction to untwist the strap previously twisted when being dispensed from the reel in a non-tangential direction through the strap feeder assembly, said control means including switch means and a floating nut for controlling the operation of said switch means, which nut is free to move longitudinally on said shaft when said shaft is rotated by said strap feeder assembly.

2. A strapping dispenser for dispensing strap axially from a reel of strap while correcting the twist caused by the axial removal of strapping from the reel, comprising: a frame, a reel assembly having a coil of strapping thereon, means for mounting the reel on said frame so that said reel may freely rotate about said mounting means, a brake disc on said reel, a freely rotatable shaft axially disposed within said mounting means, a strap feeder assembly secured to said shaft including a brake and constructed and arranged to rotate in one direction relative to said reel during strap removal in a non-tangential direction therefrom and outwardly generally along the axis of said shaft, means controlled by said shaft movement for connecting the brake of the strap feeder assembly to the brake disc on said reel for rotating the reel and strap feeder assembly together in the opposite direction when the strap withdrawal is temporarily halted to untwist the strap previously twisted when being disposed from the reel in a non-tangential direction through the strap feeder assembly.

3. A strap dispenser as set forth in claim 2 wherein the strap feeder assembly includes lever arms pivotally mounted with respect thereto and said brake means is secured to said lever arms, said strap feeder assembly further includes latch means for retaining said strap feeder assembly on said shaft.

* * * * *